United States Patent [19]

Mitchell et al.

[11] 4,391,204

[45] Jul. 5, 1983

[54] SECURITY CABINETS FOR HOTEL ROOMS

[75] Inventors: Ernst K. Mitchell, Mt. Clemens; Richard H. Terry, Bloomfield Hills, both of Mich.

[73] Assignee: Safekeeper Systems, Inc., Troy, Mich.

[21] Appl. No.: 185,653

[22] Filed: Sep. 9, 1980

[51] Int. Cl.[3] ..... E05G 3/00; E05G 1/04

[52] U.S. Cl. ..... 109/39; 109/51; 109/64; 70/DIG. 41

[58] Field of Search ..... 109/38, 39, 51, 60, 109/64; 312/35, 111; 70/DIG. 41

[56] References Cited

U.S. PATENT DOCUMENTS

| | | | |
|---|---|---|---|
| 75,389 | 3/1868 | Dodds | 109/64 |
| 1,076,587 | 10/1913 | Lapidus | 70/DIG. 41 |
| 1,105,052 | 7/1914 | Williams | 70/DIG. 41 |
| 1,149,990 | 8/1915 | Baird | 70/DIG. 41 |
| 1,178,719 | 4/1916 | Hildebrand | 109/39 |
| 1,188,460 | 6/1916 | Launbranch | 109/39 |
| 2,802,487 | 8/1957 | Breehl | 312/111 |
| 3,763,795 | 10/1973 | Wetz | 109/38 |

*Primary Examiner*—Reinaldo P. Machado

*Attorney, Agent, or Firm*—Reising, Ethington, Barnard, Perry, Brooks & Milton

[57] ABSTRACT

A security cabinet with a coin operated key-lock has the entire locking system including the coin box and a tamper detector alarm mounted inside the cabinet door. The lock cylinder of the cabinet key-lock is mounted on the latch mechanism and accessable at the front panel of the door. The lock cylinder can be removed and replaced by use of a master key with the door in a locked condition. The key-lock has a cam for operating the latch bolt and a coin detector, also mounted in the door, includes a detaining lever for blocking movement of the latch bolt unless a valid coin is deposited. The coin box is also mounted in the door. A rear panel of the door can be opened for servicing of the latch mechanism, coin box and the tamper detector.

4 Claims, 15 Drawing Figures

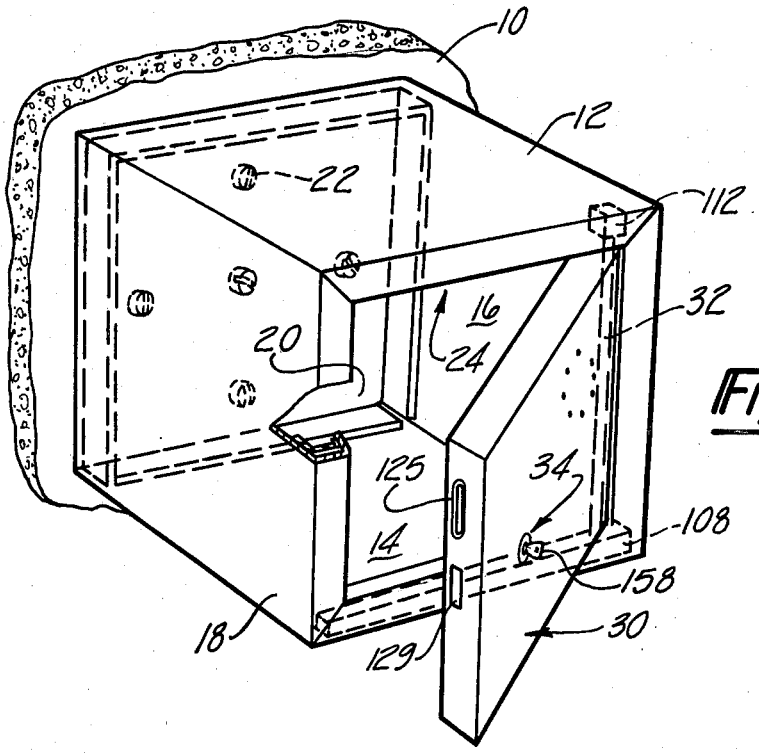
Fig-1
Fig-4
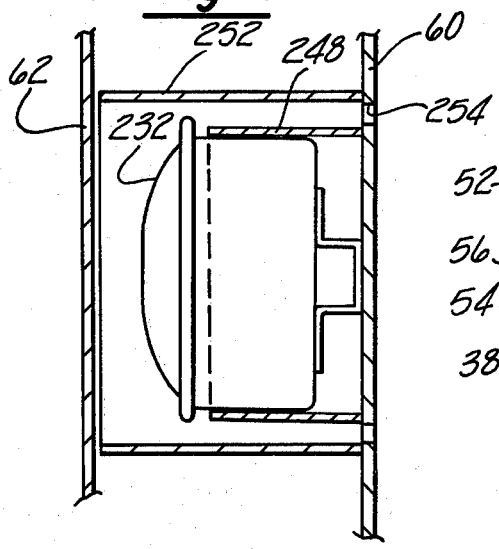
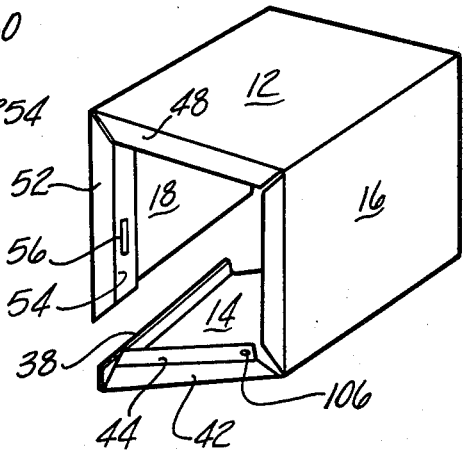
Fig-14

232
230
236
234
238
122
123
204
136
154
196
194
222
236
206
208
244
242
246
238
176
174
182
199
170
198
258
146
132
172
234
212
148
156
164
165
166
60
152
162
158
160

SECURITY CABINETS FOR HOTEL ROOMS

FIELD OF THE INVENTION

This invention relates to security cabinets for the safekeeping of valuables; more particularly, it relates to a coin operated, key-locked security cabinet.

BACKGROUND OF THE INVENTION

There has been a longstanding need in the hotel and other segments of the lodging industry for improved means for safeguarding the valuable possessions of guests. The conventional practice of allowing hotel guests to deposit their valuables in the hotel safe is inconvenient for the guests and is not widely used except for items such as jewelry of high value. There is a need for a convenient safeguarding means which is usable for items such as jewelry and cameras and which affords a high degree of security.

Heretofore, security cabinets have been provided which are especially adapted for use in the guest rooms of hotels and the like. Such cabinets are designed to be secured to the wall or floor in a hotel room closet and are characterized as being coin operated, key-locked cabinets with a key which is removable from the lock only after coin deposit and locking of the cabinet. In such cabinets, the key-lock may be replaced without opening the cabinet, in the event that the guest loses the original key. To facilitate replacement of the key-lock, a retaining mechanism for the lock cylinder is controlled by a separate key-lock. Also, such cabinets are provided with an alarm which is set off in response to tampering with the cabinet.

Security cabinets which are known in the prior art leave much to be desired, especially in respect to servicing of the cabinets by the security officer of the lodging establishment and in respect to the degree of security afforded by the cabinets. A general object of this invention is to provide an improved coin operated, key-locked security cabinet which overcomes certain disadvantages of the prior art.

SUMMARY OF THE INVENTION

In accordance with this invention, a security cabinet with a coin operated key-lock has the entire locking system installed inside the cabinet door. The cabinet key-lock has a lock cylinder mounted on a latch mechanism and accessible at the outer or front panel of the door. When the cabinet is unlocked, the guest key for opening the cabinet is retained in the lock cylinder. The inner or rear panel of the cabinet door serves as a service access door and is fitted with a service access key-lock, which may be of a low degree of security since it cannot be reached when the cabinet door is locked. The cabinet door contains the latch mechanism and a coin detector, which serves to block the latch mechanism unless a valid coin is deposited. A latch actuator is coupled with the cylinder drum of the cabinet key-lock for actuation of the latch mechanism. Also, the door contains a coin collector and, preferably it also contains an alarm which is set off in response to tampering with the cabinet.

Also, in accordance with this invention, the cabinet lock cylinder may be replaced when the cabinet is locked by means of a master key which actuates the cylinder drum to release the cylinder from the latch housing without unlocking the cabinet. The operating shaft of the cylinder drum carries a retaining member which releasably secures the cylinder to the latch mechanism.

Further, according to this invention, an alarm for detecting tampering with the cabinet is armed by locking of the cabinet and may be disarmed by use of the master key in the cabinet lock cylinder. For this purpose, an arming switch is actuated in one sense when the cylinder drum is turned by the guest key for locking the cabinet and it is actuated in the opposite sense when the cylinder drum is turned by the master key for removal of the lock cylinder.

Further, according to this invention, a security cabinet comprises two, bottom and side walls and a door frame which are formed of a unitary piece of sheet steel. A sheet of steel comprising four serially connected rectangular sections each having a foldable tab at the forward side is folded on lines between adjacent sections to form the bottom, side walls and top of the cabinet. The abutting free edges of the open corner of the cabinet are welded together and the tabs are bent inwardly and preferably welded along their adjoining edges to form a door frame. A rear wall is fitted in the rear opening of the bottom, side walls and top and welded thereto around the periphery. A cabinet door is hingedly mounted by a single hinge rod which extends through one edge of the door and into the top and bottom of the door frame.

A more complete understanding of this invention may be obtained from the detailed description that follows taken with the accompanying drawings.

DESCRIPTION OF THE DRAWINGS

FIG. 1 is a pictorial view, with parts broken away, of the security cabinet in a typical wall mounting, FIG. 4 shows the horn of the alarm system, FIG. 14 illustrates the unitary sheet metal structure of the top, side walls and bottom of the security cabinet.

BEST MODE FOR CARRYING OUT THE INVENTION

Figure 2:
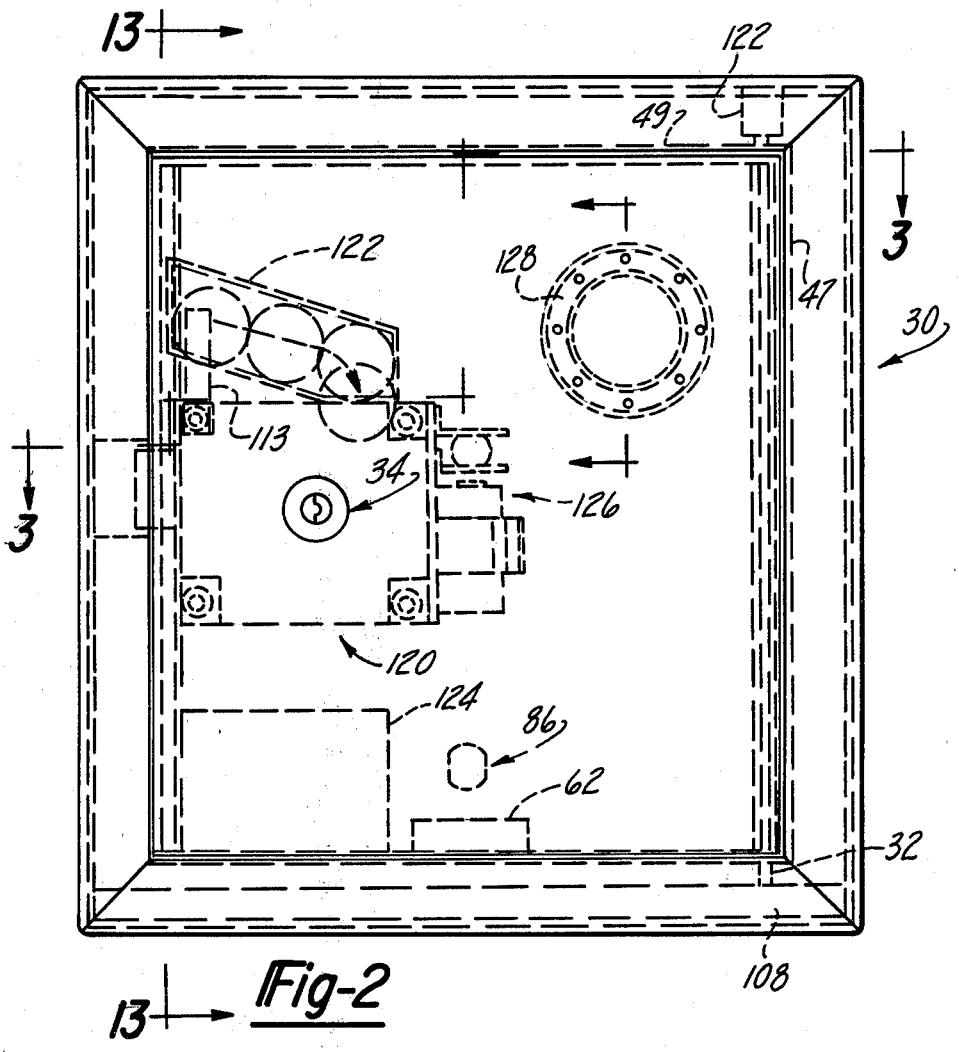
FIG. 2 is a front view of the cabinet.

Referring now to the drawings, there is shown an illustrative embodiment of the invention in a security cabinet having a coin operated key-lock and which is especially adapted for installation in guest rooms of a hotel. It will be appreciated, as the description proceeds, that the invention is also useful in other applications.

In FIG. 1, the security cabinet is shown in a typical surface mounting on a wall 10, as in the closet of a hotel room. The cabinet comprises top and bottom panels 12 and 14, respectively, and side panels 16 and 18 in a rectangular configuration. A rear panel 20 is adapted for mounting on the wall surface and is secured thereto by a set of screws 22. The front of the cabinet is provided with a door frame 24 which extends inwardly from the top panel 12, bottom panel 14 and side panels 16 and 18. A cabinet door 30 is adapted to open and close the cabinet and is hingedly mounted on the door frame 24 by a hinge pin 32. As shown in FIG. 1, the door 30 carries a key-lock 34 which includes a guest or user's key 158. The guest key 158 cannot be removed from the lock cylinder unless it is locked and hence the key serves also as a handle for the cabinet door.

Figure 3:
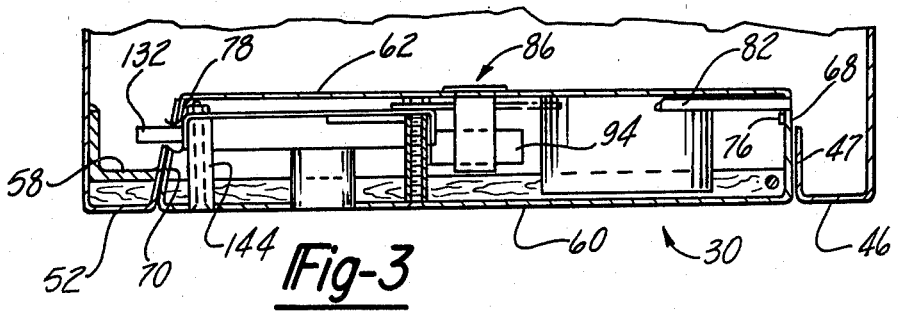
FIG. 3 is a view taken along lines 3—3 of FIG. 2.

Before proceeding with further description of the cabinet door 30, it will be helpful to consider further details of construction of the cabinet. It is noteworthy that the top panel 12, bottom panel 14 and side panels 16 and 18 of the cabinet, as well as the door frame 24, are formed of a unitary piece of sheet metal. The manner in which this construction is effected as illustrated in FIG. 14 which shows a single piece of sheet metal partially folded to form the cabinet. The sheet metal comprises four sections or panels 12, 14, 16 and 18 which are serially connected with each other and folded on lines between contiguous panels for forming a rectangular box structure. The bottom panel 14 is provided, at its side edge, with a flange 38 which is folded in a plane perpendicular to the panel 14. The bottom panel 14 also has, at its front edge, a first flange segment 42 extending perpendicular thereto and a second flange segment 44 extending parallel to the panel 14. Similarly side panel 16 has, at its front edge, a first flange segment 46 perpendicular to the panel and a second flange segment 47 (see FIGS. 3 and 14) extending parallel to the panel 16. In a same manner, top panel 12 has a first flange segment 48 extending perpendicular thereto and a second flange segment (not shown) extending parallel thereto. Side panel 18 is similar in that it has a first flange segment 52 perpendicular to the panel 18 but it differs in that a second flange segment 54 extends obliquely of the panel 18 and the first flange segment 52. The ends of the pairs of flange segments are formed to provide a miter joint between adjacent flanges which are welded together. Also the flange 38 is welded to the panel 18. The door frame 24 is constituted by the sets of first and second flange segments, described above, with the set of second flange segments serving as the door jamb. The flange segment 54, as shown in FIG. 3, is suitably beveled to match the beveled edge of the door which will be described below. The flange segment 54 defines an aperture or keeper 56 for the latch bolt which will be described below. The flange segment 54 is reinforced by an angle iron 58 welded in place, as shown in FIG. 3. The rear panel 20 of the cabinet is of tray configuration with flanges on all four sides which are welded to the top, bottom and side panels of the cabinet.

The door 30 is a double layer, hollow core structure formed of sheet metal. The door comprises an outer or front panel 60 and an inner or rear panel 62. The front panel 60 is provided with top and bottom flanges 64 and 66 (see FIG. 13) and side flanges 68 and 70 (see FIG. 3). The adjoining flanges are welded at the seams for structural rigidity. The rear panel 62 constitutes a service panel for access to the locking system. The rear panel 62 is provided with top and bottom flanges 72 and 74 (see FIG. 13) and also the side flanges 76 and 78 (see FIG. 3).

Figure 13:
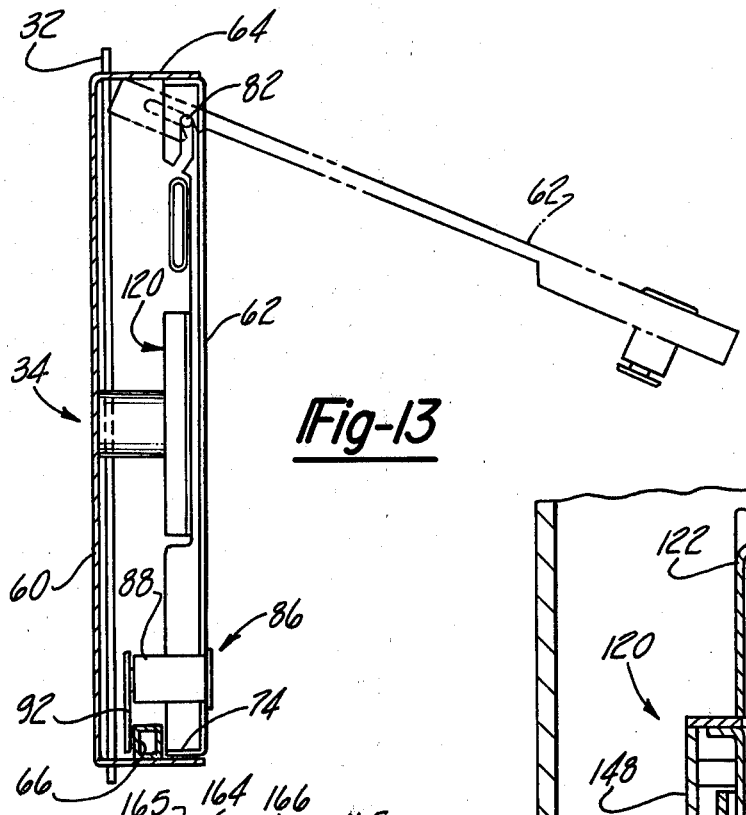
FIG. 13 is a sectional view of the cabinet door with the access door in alternate positions.

For the purpose of providing access to the interior of the cabinet door 30, the rear or service panel 62 is hingedly mounted on the front panel 60, as shown in FIG. 13. A horizontal hinge pin 82 extends across the upper portion of the front panel and is fixedly mounted in the side flanges 68 and 70 of the front panel. The service panel 62 is pivotally supported on the hinge pin 82 by the side flanges 76 and 78. Each of the side flanges defines an open L-shaped slot 84 for receiving the hinge pin 82. The slot 84 is located relative to the upper edge of the panel 62 so that the edge of the panel can be inserted above the hinge pin into the front panel 60 to allow the hinge pin 82 to enter the slot. In this position, the service panel 62 is open (as shown in dash lines in FIG. 13) and the panel 62 is retained in the open position by the upper flange 64 of the front panel 60 which prevents rotation of the service panel about the hinge pin 82. The service panel 62 is moved to the closed position by pulling the service panel 62 away from the front panel 60 until the hinge pin 82 reaches the top of the slot 84 which allows the service panel 62 to swing to the closed position within the flanges of the front panel 60 (as shown in full line in FIG. 13). The service panel 62 is provided with a key-lock 86 for locking the panel in the closed position. The key-lock 86 comprises a conventional lock cylinder 88 mounted in the service panel 62 and having a lock cam 92 which is rotatable with the cylinder drum by key operation. A keeper 94, in the form of a rectangular tube, is welded to the lower flange 66 of the outer panel 60. The keeper 94 serves also as a door stop for the service panel 62.

Reverting now to FIG. 1, the manner in which the door 30 is mounted in the door frame 24 will be described. The hinge pin 32 extends through a pair of holes in the upper and lower flanges 64 and 66, respectively, of the front panel 60. The door frame 24 is provided with a hole 106 in the lower part of the jamb and an aligned hole (not shown) in the upper part of the jamb. The door 30 is installed by inserting the upper end of the hinge pin 32 into the hole in the upper jamb while the door is held at an angle to the door frame 24 and the hinge pin 32 is slid upwardly through the frame so that the lower end of the hinge pin clears the bottom edge of the frame; then, with the hinge pin aligned with the lower hole 106 the hinge pin is allowed to drop into the hole 106. A rectangular bar 108, suitably of wood, is disposed under the lower jamb (flange segment 44) of the door frame (see FIG. 2). This bar 108 serves as an abutment for the hinge pin 32 and also fills the cavity behind the door frame on the bottom panel 14 of the cabinet. The bar 108 is secured in place by cementing it to the bottom panel 14. A block 112, suitably of wood, is fitted above the upper jamb after the hinge pin 32 is dropped into the hole 106. The block 112 is then fixed in place by cement to prevent the hinge pin 32 from being removed from the door frame 24.

As stated above, all components of the locking system for the security cabinet are mounted in the cabinet door 30. Referring now to FIG. 2, the arrangement the locking system will be described. The locking system comprises, in general, a latch mechanism 120 which is coin controlled and which is actuated by the key-lock 34 which takes the form of a key operated cam lock. A coin chute 122 is operatively connected with the latch mechanism 120 and a coin box 124 is disposed beneath the latch mechanism 120. An alarm 126 is mounted on the latch mechanism 120 and includes an alarm horn 128 which is mounted on the front panel of the door. The coin chute 122 is mounted on the latch mechanism 126 by a bracket 123. The coin chute extends from the latch mechanism to a coin slot 125 in the edge of the door 30. The edge of the door 30, specifically the side flange 70, is provided with a slot 129 for a latch bolt 132 of the latch mechanism 120. The slot 129 for the bolt is aligned with the keeper 56 which receives the lock bolt in the door frame. All of the components of the locking system just described are accessible through the service panel 62 when the cabinet door 30 is opened.

The lock mechanism 120 will now be described in detail with reference to FIGS. 5 and 6. It comprises a latch housing 136 which is a rectangular sheet metal box with an open top. The housing 136 is provided with mounting holes 138 in the corners thereof which receive a set of mounting bolts 142 to secure the housing to the front panel of the door 30. Each of the mounting bolts 142 extends from the front panel of the door through a respective stand off 144 and through the mounting holes in the housing 136 with a nut on the backside of the housing. (See FIG. 3). The housing 136 contains a latch plate 146 which carries the latch bolt 132 and which is slidably mounted in the housing. A cover plate 148 is disposed over the open top of the housing 136 and is secured thereto by a set of three bolts 152 which threadedly engage respective mounting bosses 154 in the housing 136. The key operated cam lock 34 is mounted in the cover plate 148 in alignment with an opening in the outer panel 60 of the door. For this purpose, the cover plate 148 is provided with a reinforcing plate 154 welded thereto with an aperture 156 extending therethrough to receive the inner end of the cam lock 34.

The cam lock 34, as stated above, is operative to lock and unlock the cabinet door by use of the user's key 158. It is also removable from and replaceable in the latch mechanism by use of a master key 160. The cam lock 34 has a key and cylinder construction of known design. The cam lock 34 comprises a lock cylinder 162 which carries a double ended bar or cam 164 on the rotatable shaft of the cylinder drum. The cam 164 carries an actuator pin 165 at one end thereof for coaction with the latch plate 146 in a manner to be described subsequently (see FIGS. 11 and 12). The master key 160 can be removed from the cylinder only when the lock is in the locked condition. With the master key in the cylinder in the locked condition, the cam 164 is positioned parallel to the flat portion 166 on the cylinder (see FIG. 12). In this condition, the cylinder may be inserted into the aperture 156 with the flat portions of the cylinder in alignment with the flat portions of the aperture since the ends of the cam 164 are aligned with the rectangular notch portions of the aperture. Rotation of the master key in a clockwise direction through about 45° causes a similar rotation of the cam 164 so that it is misaligned with the notches in the aperture 156. This orientation of the cam 164 prevents removal of the lock cylinder from the cover plate 148. The master key can be removed from the lock cylinder by an additional clockwise rotation thereof through about 90° of free rotation which does not cause any displacement of the cam 164. With the lock in the locked condition and hence the cam 164 in the orientation shown in dashed lines in FIG. 11 and the master key removed, the lock cylinder is properly installed and in readiness for use in locking and unlocking the cabinet door. This condition of the lock and the orientation of the cam 164 is the same as that with the cabinet door closed and locked. However, the initial installation of the cylinder 162 should be made with the latch plate 146 and bolt 132 in the locked position. This aligns the actuating pin 165 on the cam 164 with an actuating slot 170 on the latch plate 146.

With the cylinder 162 installed, as described above, and the cam 164 in the locked position and the master key 160 removed therefrom, the user key 158 may be inserted in the cylinder. The user key may be rotated in a counterclockwise direction (as viewed in FIG. 6) through about 90° of free travel which does not change the position of the cam 164. In this position, the user key 158 may be removed from the cylinder. When it is reinserted, it may be rotated in a clockwise direction about 180° and this motion will rotate the cam 164 through the same displacement to a bolt unlocked position. This bolt unlocked position is obtained with the cam 164 in the orientation shown in full line in FIG. 11. The manner in which the bolt 132 is moved between the locked and unlocked positions will be described below.

Figures 5, 15:
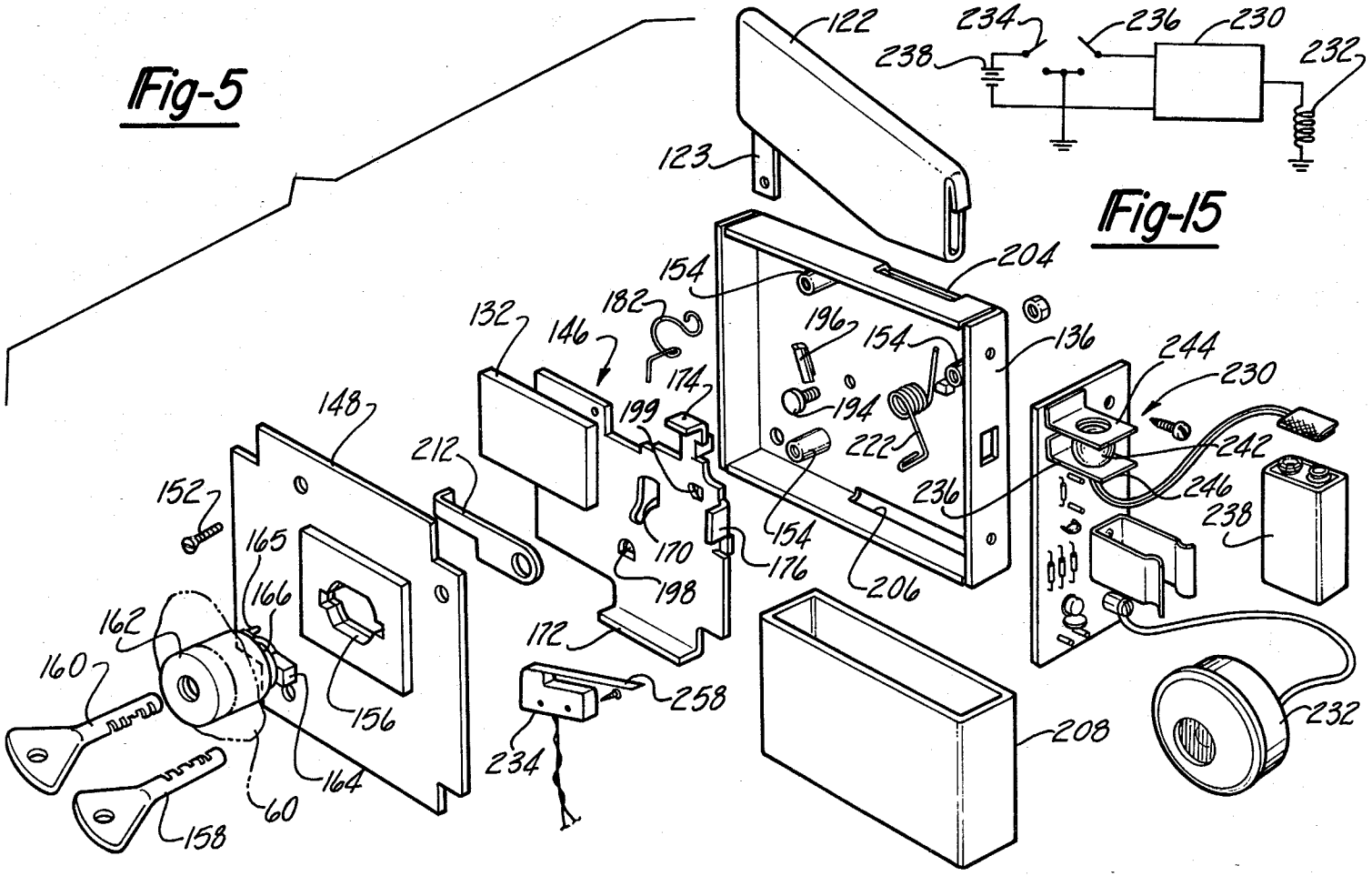
FIG. 5 is an exploded view of the latch mechanism with the cabinet key-lock, the coin detector and the alarm system.
FIG. 15 is a diagram of the alarm circuit.
Figure 6:
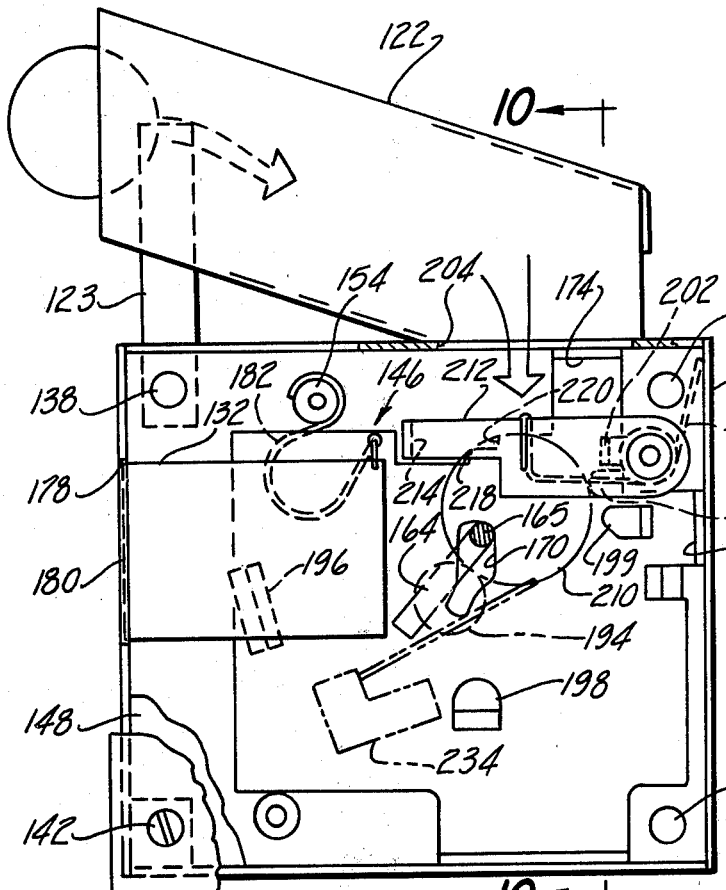
FIG. 6 shows an elevation view of the latch mechanism including the coin detector, with a valid coin in place and with the latch plate in the retracted or unlocked position.

Referring further to FIGS. 5 and 6, the latch mechanism 120 will be further described with respect to the details of the latch plate 146 and latch bolt 132. The latch bolt 132 is a rectangular steel plate and is welded to the latch plate 146 for movement therewith. The latch plate 146 is a generally rectangular steel plate with flanges 172 and 174 extending perpendicular to the plate. These flanges are disposed on opposite sides of the plate and are spaced so as to slidingly engage the side walls of the housing 136 for guiding the motion of the plate 146. The plate 146 also includes a flange 176 which extends perpendicular to the plate and which is adapted to engage the rear side walls of the housing 136 to limit the motion of the plate 146 in its retracted position. The retracted position of the plate 146 is shown in FIG. 6. The forward side wall of the housing 136 defines a slot 178 for the bolt 132. With the latch plate 146 in the retracted position, the bolt 132 is positioned with its forward edge 180 part way through the slot 178. The plate 146 is biased by an over center spring 182. The spring 182 is generally of reverse-S configuration and has the upper loop anchored by the mounting boss 154 and the free end of the lower loop disposed in an opening 184 in the latch plate. With the latch plate in the retracted position, as shown in FIG. 6, the spring 182 urges the flange 176 of the plate against the rear side wall of the housing 136. When the latch plate 146 is in the extended position, i.e. the bolt locked position (see FIG. 8) the bias spring 182 urges the forward edge 186 of the plate into engagement with the front side wall of the housing 136. The movement of the latch plate 146 between the unlocked and locked positions is effected by the actuating pin 165 in the actuating slot 170 when the user's key is turned to operate the lock 34, as described above. However, this actuation of the latch plate 146 is subject to control by the coin detector which is incorporated in the lock mechanism.

The coin detector comprises a series of coin stops 192, 194 and 196 on the back wall of the housing 136 and a coin stop 196 on the inner surface of the latch plate 146. It also comprises a set of coin pushers 198 and 202 on the back surface of the latch plate 146. The coin stop 192 is a piece of sheet steel welded to the back wall of the housing 136. The coin stop 194 is a circular steel plate having a coaxial stem which is threaded and fitted into an opening of the back plate of the housing 136. The coin stop 14 is commonly referred to as a fee pin and, as will be apparent subsequently, the size of the fee pin determines the size of coin which will be effective or valid in the coin detector. The coin stop 196 is suitably formed as a tang which is punched from the rear wall of the housing 136. The coin stops have a thickness which is somewhat greater than the thickness of the coin and serve as abutments for seating of the latch plate 146. The coin pusher 198 is formed as a tang which is stamped out of the latch plate 146 and similarly the coin stop 198 is formed as a tang stamped from the plate 146. The coin pusher 202 is formed as a flange or ear which is stamped from the edge of the latch plate 146.

The coin detector includes the coin chute 122 which connects the coin slot at the edge of the door with a coin slot 204 in the top side wall of the housing 136. Another coin slot 206 is provided in the bottom side wall of the housing 136 (see FIG. 5). The coin slots and coin stops, just described, are of such size and spacing so as to detect whether a coin 210 is being deposited in the coin detector is valid or counterfeit. If the coin is of larger diameter than the valid size coin it cannot pass through the first coin slot 125. If the coin is counterfeit and of smaller diameter than the valid coin size, the coin will pass through the coin chute 122 and slot 204 and fall between the coin stops 192 and 194 and thence through the exit coin slot 172 into the coin box 208. (See FIG. 5). If the coin is a valid coin its diameter will be such that it will be stopped by the coin stops 192 and 194 and retained in the position shown in FIG. 6. A valid coin in this position is effective to enable actuation of the latch plate 146, in a manner which will be described presently.

The coin detector also includes a detainer lever 212 which blocks the actuation of the latch plate 146 unless a valid coin 210 is deposited. The detainer lever 212 is pivotally mounted on the boss 154 at the upper right corner of the latch housing 136. The lever 212 is provided with a hook 214 on its free end which is biased downwardly against the flat edge 216 of the latch plate 146. The latch plate is provided with a stop shoulder 218 and shoulder 220. The hook 214 is adapted to engage a stop shoulder 218 on the upper edge of the latch plate 146 when the latch plate is moved toward the extended position, in the absence of the coin 210. The detainer level 212 is biased in a counterclockwise direction by a coil spring 222 which has one free end seated against the rear side wall of the housing 136 and the other free end hooked over the detainer lever 212. In the absence of a valid coin 210 being held by the coin stops 192 and 194, the detainer lever 212 is effective to prevent the full throw or extension of the latch bolt 132. Rotation of the user's key in the counterclockwise direction will cause some rotation of the cam 164 and hence some movement of the latch plate by the actuator pin 165. However, the hook 214 on the detainer lever will engage shoulder 218 and prevent further movement of the latch plate.

Figure 7:
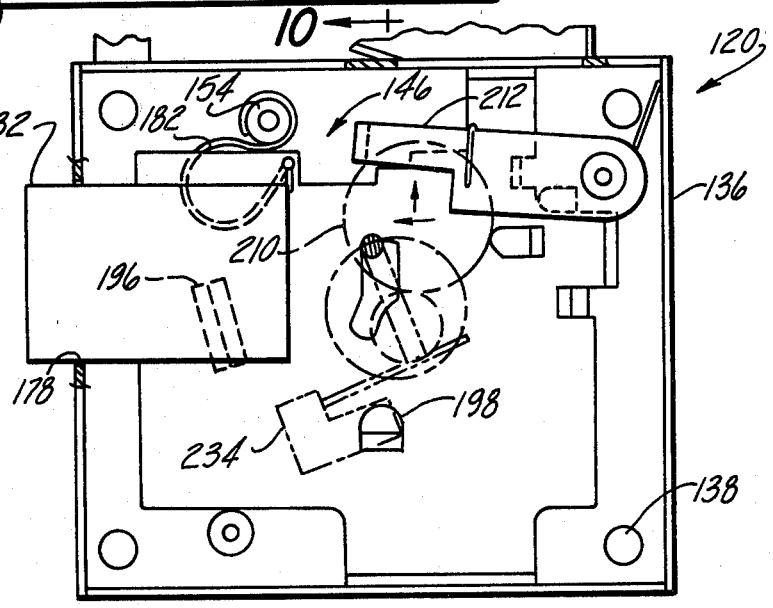
FIG. 7 is similar to FIG. 6 but shows the latch plate in the intermediate, or partially extended positions.
Figure 8:
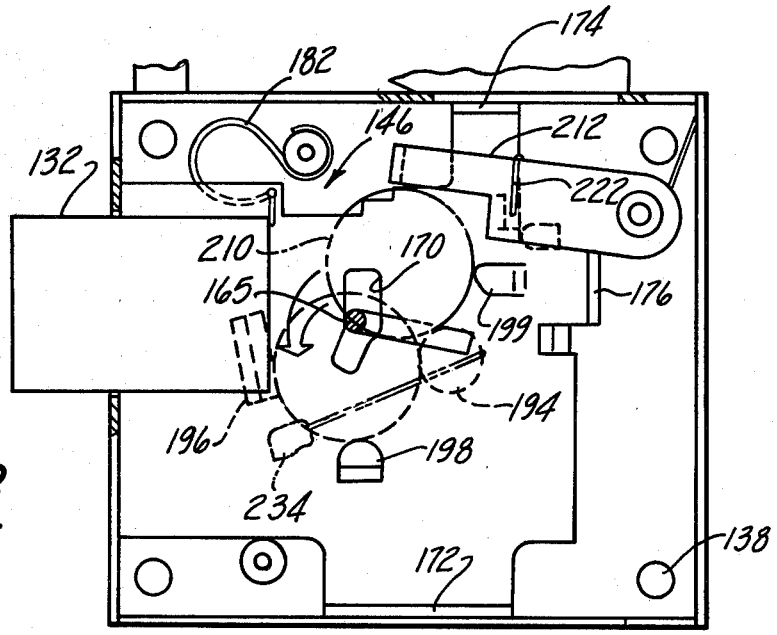
FIG. 8 is similar to FIG. 7 but shows the latch plate in the fully extended or locked position.
Figure 9:
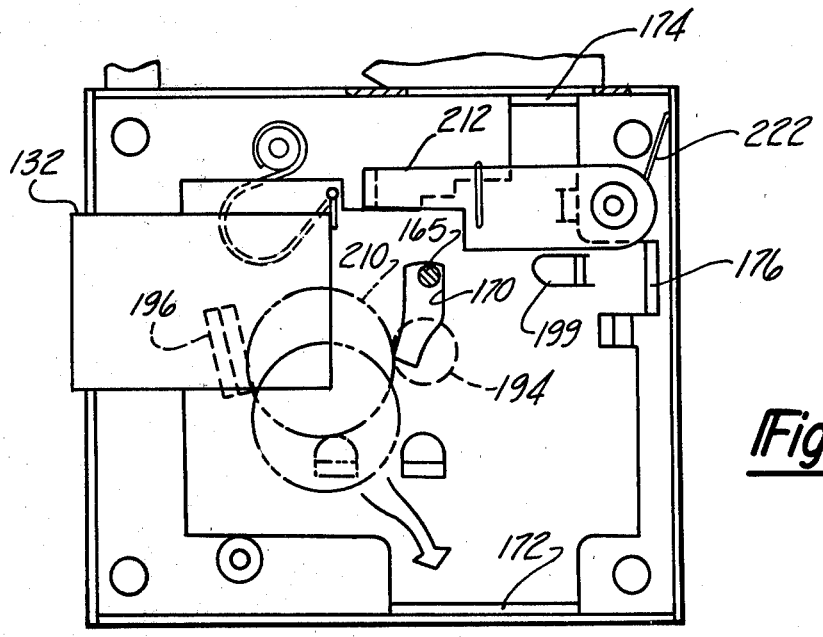
FIG. 9 is similar to FIG. 8 and shows the latch plate in the fully retracted position which allows the coin to drop into the coin box.

When a valid coin 210 is deposited, it is held in the position shown in FIG. 6 between the coin stops 192 and 194. When the user's key is rotated in a counterclockwise direction to lock the cabinet door, the latch plate 146 will be moved toward the extended or bolt locked position; the hook 214 on the detainer lever will engage the edge of the coin 210 and be cammed upwardly thereby so as to avoid engagement with the stop shoulder 218. Accordingly, the latch plate 146 is allowed to continue its travel toward the extended or bolt locked position. As the latch plate 146 continues its travel, the coin pushers 199 and 202 thereon engage the edge of the coin 210 and cause it to travel with the latch plate. The latch plate 146 is shown in FIG. 7 in an intermediate position with the latch bolt 132 partially extended. In this intermediate position, the detainer lever 212 is cammed upwardly by the coin 210 and the coin is resting on the top of the coin stop 194. When the latch plate 146 reaches its fully extended position, as shown in FIG. 8, the detainer lever 212 is lifted or cammed by the coin 210 to a position where it clears the stop shoulder 218 and also clears the shoulder 220. In its fully extended position of the latch plate 146, the coin 210 is moved beyond the top of the coin stop 194 and is dropped to a position where it rests on the coin stops 196 and 198. When the cabinet door is unlocked by rotation of the user's key in the clockwise direction, the latch plate 146 is moved toward the retracted position by the actuator pin 165. The movement of the latch plate in this direction is unimpeded except for the spring bias of the overcenter spring 182 and hence the latch plate is retracted until the flange 176 engages the rear side wall of the housing 136. FIG. 9 shows the latch plate 146 in an intermediate position just before the fully retracted position is reached. This motion of the latch plate 146 causes the coin stop 198 to be moved out from under the coin 210 and the coin is allowed to drop through the exit coin slot 206 into the coin box 208. Thus, the cabinet door 30 is unlocked and can be opened for access to the interior of the cabinet.

As stated above, the locking system includes the alarm 126. The alarm 126 is adapted to detect any motion of the cabinet which would signify tampering by unauthorized persons. The alarm 136 comprises an alarm circuit 230 and a horn 232 (see FIGS. 5 and 15). The alarm also includes an on/off or arming switch 234 and a tilt detector switch 236. The alarm is powered by a battery 238. The arming switch 234 and the tilt detector switch 236 are connected in series with the battery 238 across the input terminals of the alarm circuit 230 and the horn 232 is connected across the output of the alarm circuit. The alarm circuit is of conventional design. When the arming switch 234 is opened, the alarm circuit 230 is disabled and the horn 232 cannot be energized. However, when the arming switch 234 is closed, closure of the tilt detector switch 236, even a momentary closure, is effective to cause the alarm circuit to energize the horn 232, even after the tilt detector switch 236 is reopened. The alarm circuit continues to energize the horn until the arming switch 234 is opened or until the battery is run down.

In the alarm 126, the tilt detector switch 236 takes a form of a conventional ball contact switch wherein a metal ball 242 serves as a bridging contact between a pair of metal plates 244 and 246 which are normally oriented in a horizontal plane. Each of the plates defines a circular opening and the ball normally rests on the bottom plate 246 out of contact with the upper plate 244. The ball 242 is responsive to any significant tilting or impact of the cabinet to move into engagement with both plates 244 and 246 and thus close the switch. The horn 232 is also of conventional design. As shown in FIG. 4, the horn 232 is mounted on the front panel 60 of the door 30. Preferably, the horn is mounted by a cylindrical sleeve 248 which is attached, as by welding, onto the front panel 60. The horn 232 is surrounded by a second metal sleeve 252 which defines an annular air space between it and the sleeve 248. The sleeve 252 is also fixed to the panel 60, as by welding, and the free end thereof extends into close proximity with the rear panel 62. A series of circular apertures 254 in a circular configuration are provided in the front panel 60 to allow emission of the sound waves from the horn. The sleeve 252 serves to prevent the sound waves from being attenuated within the cavity of the door 30. The sleeve 248, in addition to mounting the horn, serves to protect it from disablement by a sharp tool which an intruder might poke through the apertures 254.

Figure 11:
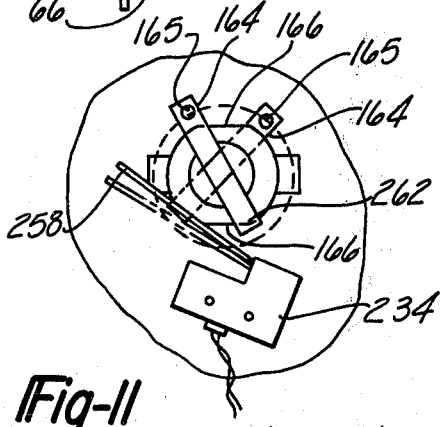
FIG. 11 shows a detail of construction including the lock cylinder retaining member and arming switch.
Figure 10:
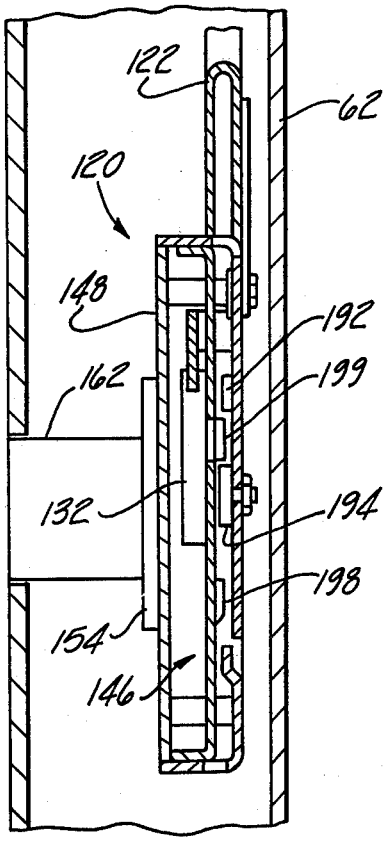
FIG. 10 is a view taken on line 10—10 of FIG. 6.
Figure 12:
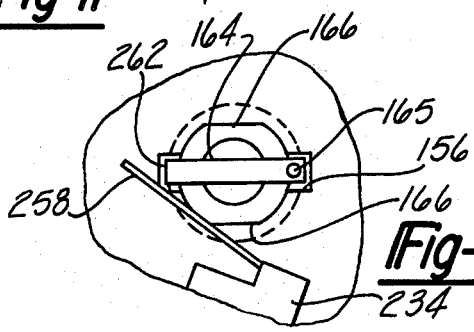
FIG. 12 is similar to FIG. 11 showing the retaining member in a different position.

The arming switch 234 is adapted to provide for authorized disablement of the alarm. To this end, the arming switch is opened whenever the cabinet door is unlocked. This prevents unwanted sounding of the alarm by slamming the cabinet door by the authorized user. Further, the arming switch 234 may be opened by use of the master key to turn off the alarm after there has been unauthorized tampering with the security cabinet. The arming switch 234 takes the form of a conventional microswitch and is mounted by screws on the back face of the cover plate 148. The switch 234 has an actuating arm 258 which is actuated by the end 262 of the lock cam 164 (see FIGS. 11 and 12). As shown in FIG. 12, the actuating arm 258 of the arming switch 234 is in a switch open position when the cam 164 is parallel to the flats 166 on the cylinder; this position of the cam can be obtained only by use of the master key 160 and is the same position required for removal and replacement of the lock cylinder. As shown in FIG. 11, when the cam 154 is rotated to the locked position, as shown in dashed lines, the actuating arm 258 of the arming switch is in the switch closed position. When the cam 164 is rotated by the user's key 158 to the unlocked position (full line position of cam 164 in FIG. 11) the actuating lever 258 is in the switch open position. Thus, the alarm 126 is disabled by opening the arming switch 234 by operation of the master key or by unlocking the cabinet door with the user's key.

The operation of the security cabinet may be summarized as follows. With the door 30 opened, as depicted in FIG. 1, the latch bolt 132 is retracted and the user's key 158 cannot be withdrawn from the key-lock 34. If the user deposits a valid coin in the coin slot 125, it will be retained, as shown in FIG. 6 by the coin stops 192 and 194. To lock the cabinet. the door is closed and the user's key is rotated. This rotates the lock cam 164 which, through the actuating pin 165 and slot 170 moves the latch plate 146 toward its extended position. The detaining lever 212 is cammed upwardly by the coin 210, avoiding engagement with the shoulders 218 and 220. Thus, the latch plate moves to the fully extended position and the latch bolt is in the bolt locked position. With the door closed and locked, the user's key may be removed. In this condition the alarm 126 is armed by the arming switch 234 and tampering with the cabinet will close the tilt detector switch 236 and set off the alarm. In this event, the horn 232 of the alarm will be energized until the battery runs down or until the master key 160 is inserted into the cylinder 132 and rotated to the position shown in FIG. 12 which opens the arming switch 234. With the security cabinet door closed and locked, the door may be unlocked by insertion of the user's key 158 into the cylinder 162 and rotation thereof. This retracts the latch plate 146 and latch bolt 132 so that the door may be opened. The user's key is held in the cylinder 162 so long as the key-lock 34 remains unlocked. In the event that the user loses the user's key, or for other reasons, it may be desirable to remove and replace the cylinder 162. With the door locked and the user's key removed, the master key 160 is inserted into the cylinder 162 and rotated. This moves the lock cam 164 into alignment with the rectangular notches in the aperture 156 (see FIG. 12) and the cylinder may be pulled outwardly and detached from the cover plate 148 of the latch mechanism. A replacement cylinder may be inserted into the cover plate 148 by operating the master key to align the lock cam 164 with the flats 166 on the cylinder. This allows the cylinder to be inserted into the aperture 156 and it is retained in place by rotation of the key. After removal of the master key, the lock is in readiness for operation by the user.

Although the description of this invention has been given with reference to a particular embodiment, it is not to be construed in a limiting sense. Many variations and modifications will now coour to those skilled in the art. For a definition of the invention, reference is made to the appended claims.

What is claimed is:

1. A security cabinet including a door frame and a door hingedly mounted thereon, said door having front and rear panels in spaced relation, a latch keeper in said door frame, a tamper detector alarm mounted inside said door, a latch mechanism mounted in the door and having a movable latch plate and a bolt movable therewith adapted to engage said latch keeper when the door is closed and the latch plate is moved from a retracted position to an extended position, a key-lock mounted in said latch mechanism and having a cylinder adapted to receive a user's key through the front panel of said door, said key-lock including a cam coacting with said latch bolt and adapted to move it between said retracted and extended positions, a coin detector mounted in the door and including a detaining lever adapted to engage said latch plate for blocking movement thereof to the extended position unless a valid coin is deposited in said coin detector, whereby said latch plate may be actuated to the fully extended position by rotation of the user's key only when a valid coin is deposited, a coin box mounted in the door and adapted to receive coins from said coin detector, said rear panel of said door being movably mounted on said front panel for movement between closed and open positions whereby said rear panel may be opened for servicing of said latch mechanism, coin box and coin detector, a lock means for said rear panel.

2. A security cabinet including a door frame and a door hingedly mounted thereon, said door having front and rear panels in spaced relation, a latch keeper in said door frame, a latch mechanism mounted in the door and having a movable latch plate and a bolt movable therewith adapted to engage said latch keeper when the door is closed and the latch plate is moved from a retracted position to an extended position, a key-lock mounted in said latch mechanism and having a cylinder adapted to receive a user's key through the front panel of said door, said key-lock including a cam coacting with said latch bolt and adapted to move it between said retracted and extended positions, a coin detector mounted in the door and including a detaining lever adapted to engage said latch plate for blocking movement thereof to the extended position unless a valid coin is deposited in said coin detector, whereby said latch plate may be actuated to the fully extended position by rotation of the user's key only when a valid coin is deposited, said rear panel of said door being movably mounted on said front panel for movement between closed and open positions whereby said rear panel may be opened for servicing of said latch mechanism and coin detector, and lock means for said rear panel, said cylinder also being adapted to receive a master key for operation of the key-lock, said latch mechanism including a cover plate having an aperture therein adapted to receive said cam in a first orientation relative to said cylinder, said cam being movable by said master key to a second orientation relative to said cylinder by said master key for retaining said lock cylinder in said cover plate, whereby said lock cylinder may be removed and replaced from said cover plate without unlocking the cabinet door.

3. The invention as defined in claim 2 including, a tamper detector alarm mounted inside said door, said alarm including an arming switch disposed in said latch mechanism and adapted for actuation by said cam whereby said alarm may be disarmed by operation of said master key.

4. A security cabinet including a door frame and a door hingedly mounted thereon, a latch keeper in said door frame, a latch mechanism mounted in the door having a movable latch plate and a bolt movable therewith adapted to engage said latch keeper when the door is closed and the latch plate is moved from a retracted position to an extended position, a key-lock mounted in said latch mechanism and having a cylinder adapted to receive a user's key, said cylinder being accessible at the outer surface of said door, said key-lock including a cam coacting with said latch bolt and adapted to move it between said retracted and extended positions, said cylinder being adapted to receive a master key for operation of the key lock, said latch mechanism including a cover plate having an aperture therein adapted to receive said cylinder and said cam without interference with said cam in a first orientation relative to said cylinder, said cam being movable by said master key to a second orientation relative to said cylinder with said cam in engagement with said cover plate for retaining said lock cylinder in said cover plate, whereby said lock cylinder may be removed and replaced from said cover plate without unlocking the cabinet door.

* * * * *